United States Patent [19]

Bullock

[11] 4,084,514

[45] Apr. 18, 1978

[54] DAMPING RAILWAY TRUCK BOLSTER FRICTION SHOE

[75] Inventor: Robert L. Bullock, Lombard, Ill.

[73] Assignee: Standard Car Truck Company, Chicago, Ill.

[21] Appl. No.: 719,827

[22] Filed: Sep. 2, 1976

Related U.S. Application Data

[63] Continuation-in-part of Ser. No. 590,292, Jun. 25, 1975, abandoned.

[51] Int. Cl.[2] ..... B61F 5/06; B61F 5/12; B61F 5/50; F16D 65/04

[52] U.S. Cl. ..... 105/197 DB; 105/206 R

[58] Field of Search ..... 105/193, 197 DB, 206 R, 105/197 D

[56] References Cited

U.S. PATENT DOCUMENTS

| | | | |
|---|---|---|---|
| 2,723,630 | 11/1955 | Settles | 105/206 R |
| 3,575,117 | 4/1971 | Tack | 105/197 DB |
| 3,654,871 | 4/1972 | Wallace | 105/197 DB |
| 3,851,595 | 12/1974 | Clasen | 105/197 DB |

*Primary Examiner*—Drayton E. Hoffman
*Assistant Examiner*—Howard Beltran
*Attorney, Agent, or Firm*—Kinzer, Plyer, Dorn & McEachran

[57] ABSTRACT

A friction member for use in the bolster pocket of a stabilized railroad car truck has a slanted friction surface adapted to bear against the bolster within the bolster pocket and a vertical friction surface adapted to bear against the side frame. The slanted friction surface has a generally flat portion at the lower end thereof and a generally arcuate portion at the upper end thereof. The two portions of the slanted friction surface are tangent, one to another, with the point of tangency being located so as to insure full contact between the vertical friction surface and the adjacent side frame.

10 Claims, 2 Drawing Figures

DAMPING RAILWAY TRUCK BOLSTER FRICTION SHOE

SUMMARY OF THE INVENTION

This application is a continuation-in-part of my copending application Ser. No. 590,292, filed June 25, 1975 now abandoned.

The present invention relates to a friction wedge for use in the bolster pocket of a stabilized railroad car truck and has particular relation to the slanted friction surface of such a wedge.

A primary purpose of the invention is a wedge friction surface which has a lower generally flat portion and an upper generally arcuate or crowned portion.

Another purpose is a friction wedge of the type described in which the flat and arcuate portions are tangent approximately at the midpoint of the friction surface.

Another purpose is a wedge of the type described which reduces premature wear in the bolster pocket and side frame wearing surfaces.

Another purpose is a friction wedge of the type described which redistributes both friction and wear over a larger area of the bolster pocket wearing surface.

Another purpose is a friction wedge of the type described which more uniformly distributes both friction and wear between the friction wedge and the column wear plate.

Another purpose is a friction wedge of the type described which will reduce the stress on the fore and aft portions of the bolster center plate rim.

Another purpose is a friction wedge which will permit larger longitudinal impacts to the car body with less tendency to have the truck bolster rotate about its lateral axis with respect to the side frames.

Another purpose is a friction wedge whose slanted friction surface insures contact between the vertical friction surface and the side frame.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

On a significant number of side frames inspected in the field, the dimensions between the column wear plates was found to be slightly smaller at the top than at the bottom. The difference has been found to be as much as ⅛ inch, with a large number having a difference of approximately 1/16 inch. This difference has been attributed to the manner in which the side frame casting cools. Because of this dimensional difference, there is substantially more wedging force applied at the top of the wedge than at the bottom. The magnitude of the wedging force increase can be two to ten times as great as it would be if there was equal spacing between the top and bottom of the column wear plates. The increase in force is applied to the wedge and to the top of the bolster in areas where both the wedge and the bolster are least able to support the force increase.

Field observation has also understandably shown that present-day friction castings positioned within the bolster stabilizing pocket are wearing far more at the top than at the bottom and in some instances the increased wedging force is causing failure at the top of the friction casting. In some cases the uneven wear has caused failure of that portion of the bolster which forms the top of the stabilizing pocket. Both empty and loaded cars in service have been found to have clearance between the bottom wear surface of the wedge and the side frame column wear plate. Also, field observations have shown substantially more wear on the top half of the sloping or slanted surface of the bolster pocket than on the lower or bottom half.

The present inventin is specifically designed to redistribute the force applied by the friction casting to the bolster pocket and to more evenly distribute the force applied by the friction casting upon the column wear plate. Specifically, a friction wedge formed in accordance with the present invention has an upper arcuate or crowned area along the slanted wedging surface over approximately one half of the entire friction surface, with the lower portion of the slanted surface being generally flat. Such a construction has been found to lower and thus redistribute both friction and wear over a larger area of the bolster pocket, whether there be a wear plate or not. It also redistributes and uniformly applies both friction and wear between the friction wedge and the column wear plate. This construction particularly provides the above desirable results when there is uneven spacing between the column wear plates.

Figure 1:
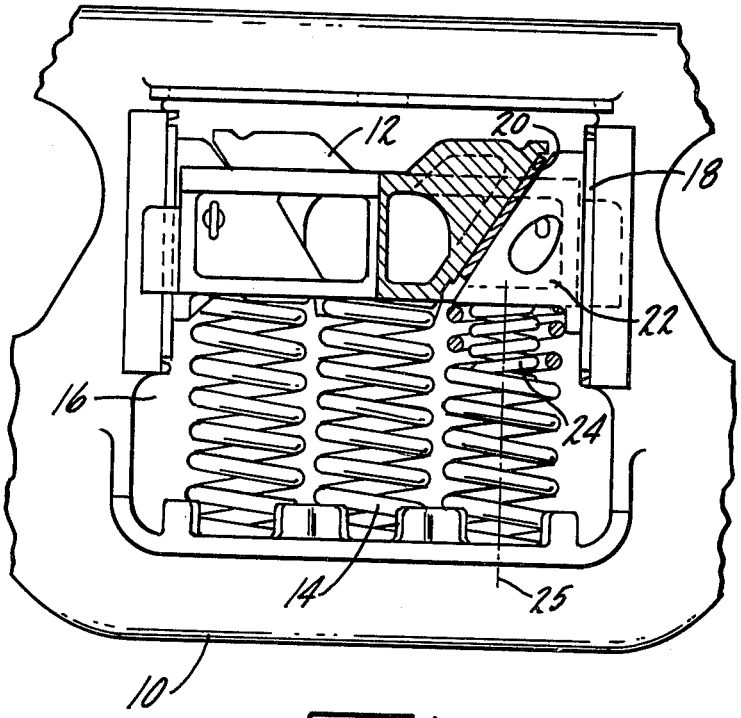
FIG. 1 is a partial side view, in part section, of a car truck side frame and bolster.

In FIG. 1, a typical side frame is indicated at 10 and the bolster is indicated at 12. Load springs 14 support the bolster within window 16 of the side frame.

At each side of window 16 there are column wear plates 18 which will conventionally be positioned opposite pockets 20 in each side of the bolster. Stabilizing wedges 22 are positioned within the pockets and are supported on stabilizing springs 24. The centerline of spring 24 is shown at 25. All of the above-described structure is generally conventional and is well known in the art.

Figure 2:
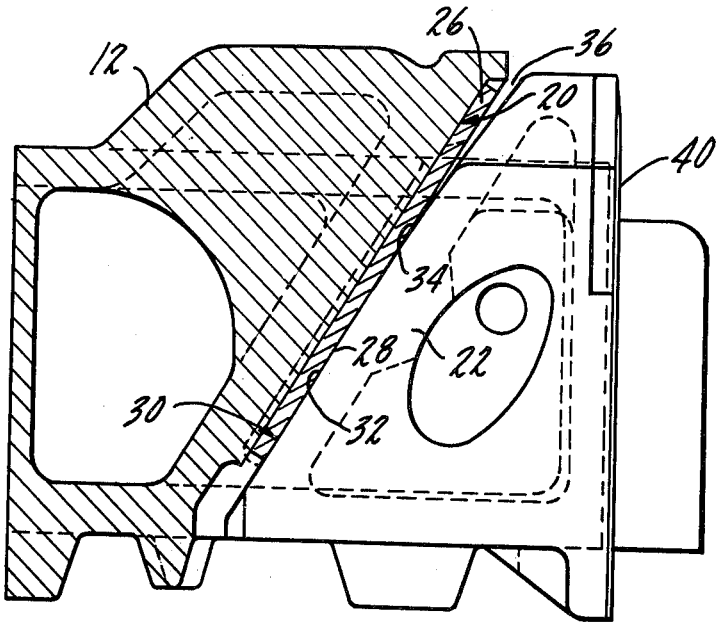
FIG. 2 is an enlarged side view illustrating the friction wedge within the bolster pocket.

Looking particularly at FIG. 2, bolster pocket 20 has a wear plate 26 positioned therein. However, it should be understood that the particular construction of the friction wedge to be described is applicable either with a wear plate within the bolster pocket or without one. Wear plate 26 has a generally flat slanted surface 28 which faces friction wedge 22. Friction wedge 22 has a slanted friction surface designated generally at 30 which faces surface 28 of wear plate 26. Approximately the lower half 32 of friction surface 30 is generally flat and thus can bear flatly against surface 28. Approximately the upper half 34 of friction surface 30 is arcuate or crowned with surfaces 32 and 34 being generally tangent at the midpoint of surface 30. Thus, there is a gap indicated at 36 near the top of the pocket which can be used to accomodate any dimensional differential between the top and bottom of the column wear plates.

Wedge 22 will have a vertical friction surface 40 which will bear against column wear plate 18. Surface 40 is generally flat, as is conventional in the art. However, it is desirable to have generally uniform applicaton of friction and wear between surface 40 on wedge 22 and wear plate 18. With the above-described dimensional difference, this has not always been possible in the past, but with a wedge having the particular characteristics and construction described and shown in FIG. 2, there is generally uniform application of force and friction between these surfaces.

To insure full contact between vertical friction surface 40 and column wear plate 18, one of the more desirable advantages of the present construction, the point of tangency between the flat and crowned portions of friction surface 30 should be located above the midpoint of vertical friction surface 40. If the point of tangency is below the midpoint of vertical friction surface 40 there may well be clearance between the bottom portion of the wedge vertical wear surface and the side frame column wear plate, thus causing uneven friction and wear on these mating surfaces. Further, it is advantageous to have a specific relationship between the intersection of spring centerline 25 with friction surface 30 and the described point of tangency. The point of tangency between the flat and crowned surfaces of friction surface 30 should be at or below the point of intersection of the centerline of spring 24 with surface 30. If the point of tangency is above the intersection of the spring centerline, there may be the described clearance between the bottom portion of vertical friction surface 40 and the column wear plate, thus leading to uneven wear.

The particular described slanted surface of the wedge will redistribute both friction and wear over a larger area of the bolster pocket and will substantially eliminate the problem of having excessive wear and force applied to the top of the wedge and to the top of the bolster pocket.

In addition, the described construction will permit larger longitudinal impacts to the car body with less tendency to have the bolster rotate about its lateral axis with respect to the side frames. This in turn will reduce the stress on the fore and aft portions of the bolster centerplate rim. One of the problems associated with excessive wear at the top of the friction wedge and the top of the bolster is that it has in the past permitted excessive rotation of the bolster relative to the side frames, which in turn has a tendency to wear the front and rear portions of the bolster center plate rim. By substantially reducing or eliminating rotation of the bolster, wear on the center plate is also reduced.

It is important to provide close tolerance on the angle of the sloping surface of the bolster pocket. The wedge angle and the bolster pocket angle should be equal or the pocket angle should be less (no more than two degrees) than the normal angle of the wedge. Thus, by maintaining surfaces which are initially formed to be generally parallel, the application force from the wedge to the bolster pocket will be distributed as uniformly as possible.

The crown on the upper half of the friction wedge is important not only to provide the above-described gap to compensate for any dimensional difference between the column wear plates, but also to permit the side frames to have some degree of rotation as the car moves over changes in cross elevation of the track in distances between axle centers.

Whereas the preferred form of the invention has been shown and described herein, it should be realized that there may be many modifications, substitutions and alterations thereto.

The embodiments of the invention in which an exclusive property or privilege is claimed are defined as follows:

1. A friction member for use in the bolster pocket of a stabilized railroad car truck including a friction surface adapted to bear against a generally flat slanted wear surface within the bolster pocket, said friction surface having a generally flat portion of substantial length generally conforming to the generally flat slanted bolster pocket wear surface and an adjoining arcuate portion of substantial length, gradually diverging from the generally flat slanted bolster pocket wear surface, said generally flat portion being tangent to said adjoining arcuate portion and extending from the area of tangency to one end of said friction surface, the arcuate portion extending from the area of tangency to the other end of said friction surface.

2. The structure of claim 1 further characterized in that said generally flat portion joins said arcuate portion approximately at the midpoint of said friction surface.

3. A friction member for use in the bolster pocket of a stabilized railroad car truck including a first friction surface adapted to bear against a side frame column member, and a second friction surface adaped to bear against a generally flat slanted wear surface within the bolster pocket, said second friction surface having a generally flat portion of substantial length generally conforming to the generally flat bolster pocket wear surface and an adjoining arcuate portion of substantial length, generally diverging from the generally flat slanted bolster pocket wear surface, said generally flat portion being tangent to said adjoining arcuate portion and extending from the area of tangency to one end of said second friction surface, the arcuate portion extending from the area of tangency to the other end of said second friction surface.

4. The structure of claim 3 further characterized in that said area of tangency of said second friction surface is located, relative to the ends of said second friction surface, so as to insure full contact between said first friction surface and the side frame column member.

5. The structure of claim 3 further characterized in that said area of tangency is above the midpoint of said first friction surface.

6. The structure of claim 3 further characterized in that said area of tangency is located approximately at the midpoint of said second friction surface.

7. A stabilized railroad car truck including a side frame having a window and a bolster extending into the window, a stabilizer pocket on each side of the bolster and a friction member positioned in each pocket, each bolster pocket having a generally flat slanted wear surface, each member having a first generally vertical friction surface bearing against the side frame and a second generally slanted friction surface, said second friction surface having a generally flat portion of substantial length, generally conforming to the generally flat slanted bolster pocket wear surfac and an adjoining arcuate portion of substantial length, generally diverging from the generally flat slanted bolster pocket wear surface, said generally flat portion being tangent to said adjoining arcuate portion and extending from the area of tangency to one end of said second friction surface, the arcuate portion extending from the area of tangency to the other end of said second friction surface.

8. The structure of claim 7 further characterized in that said area of tangency is located on said second friction surface to insure full contact between said first friction surface and the side frame.

9. The structure of claim 7 further characterized in that said area of tangency is located above the midpoint of said first friction surface.

10. The structure of claim 7 further characterized by and incluing a spring positioned between each friction member and a lower portion of said side frame and urging each friction member upwardly into its bolster pocket, each area of tangency being located at or below the intersection of the centerline of the spring and the second friction surface.

* * * * *